US005992697A

United States Patent [19]

James

[11] Patent Number: 5,992,697

[45] Date of Patent: Nov. 30, 1999

[54] WATER SQUIRTING DEVICE

[76] Inventor: Eddie H. James, Rte. #2 Box 797, Cedar Creek, Tex. 78612

[21] Appl. No.: 09/105,440

[22] Filed: Jun. 26, 1998

[51] Int. Cl.[6] ..... B67D 5/64

[52] U.S. Cl. ..... 222/175; 4/255.02; 222/79; 222/386

[58] Field of Search ..... 4/255.02, 255.03; 224/257; 222/79, 175, 386

[56] References Cited

U.S. PATENT DOCUMENTS

| | | | |
|---|---|---|---|
| 1,361,972 | 12/1920 | Drake | 4/255.02 |
| 1,684,880 | 9/1928 | Norton | 4/255.02 |
| 3,934,280 | 1/1976 | Tancredi | 4/255.02 |
| 4,911,347 | 3/1990 | Wilhite | 224/257 |
| 5,199,114 | 4/1993 | Christopher | 4/255.02 |

*Primary Examiner*—Charles E. Phillips

[57] ABSTRACT

A new water squirting device for squirting water a distance therefrom. The inventive device includes an elongate tube has inner and outer surfaces, and opposite first and second ends. The inner surface of the tube defining a lumen of the tube. The first and second ends of the tube each have an opening into the lumen of the tube. A first end cap covers the first end of the tube and has a squirt hole therethrough. One of the ends of a plunger shaft is inserted through the second end of the tube and into the lumen of the tube. A plunger head is coupled to the one end of the plunger shaft. A second end cap covers the second end of the tube. The second end cap has a central hole therethrough through which the plunger shaft is slidably extended. A handle is coupled to the other end of the plunger shaft.

6 Claims, 2 Drawing Sheets

WATER SQUIRTING DEVICE

BACKGROUND OF THE INVENTION

1. Field of the Invention

The present invention relates to water squirting devices and more particularly pertains to a new water squirting device for squirting water a distance therefrom.

2. Description of the Prior Art

The use of water squirting devices is known in the prior art. More specifically, water squirting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art water squirting devices include U.S. Pat. No. 4,193,517; U.S. Pat. No. 5,522,094; U.S. Pat. No. Des. 251,007; U.S. Pat. No. 3,796,238; U.S. Pat. No. 4,121,736; and U.S. Pat. No. 4,542,543.

While these devices fulfill their respective, particular objectives and requirements, the aforementioned patents do not disclose a new water squirting device. The inventive device includes an elongate tube has inner and outer surfaces, and opposite first and second ends. The inner surface of the tube defining a lumen of the tube. The first and second ends of the tube each have an opening into the lumen of the tube. A first end cap covers the first end of the tube and has a squirt hole therethrough. One of the ends of a plunger shaft is inserted through the second end of the tube and into the lumen of the tube. A plunger head is coupled to the one end of the plunger shaft. A second end cap covers the second end of the tube. The second end cap has a central hole therethrough through which the plunger shaft is slidably extended. A handle is coupled to the other end of the plunger shaft.

In these respects, the water squirting device according to the present invention substantially departs from the conventional concepts and designs of the prior art, and in so doing provides an apparatus primarily developed for the purpose of squirting water a distance therefrom.

SUMMARY OF THE INVENTION

In view of the foregoing disadvantages inherent in the known types of water squirting devices now present in the prior art, the present invention provides a new water squirting device construction wherein the same can be utilized for squirting water a distance therefrom.

The general purpose of the present invention, which will be described subsequently in greater detail, is to provide a new water squirting device apparatus and method which has many of the advantages of the water squirting devices mentioned heretofore and many novel features that result in a new water squirting device which is not anticipated, rendered obvious, suggested, or even implied by any of the prior art water squirting devices, either alone or in any combination thereof.

To attain this, the present invention generally comprises an elongate tube has inner and outer surfaces, and opposite first and second ends. The inner surface of the tube defining a lumen of the tube. The first and second ends of the tube each have an opening into the lumen of the tube. A first end cap covers the first end of the tube and has a squirt hole therethrough. One of the ends of a plunger shaft is inserted through the second end of the tube and into the lumen of the tube. A plunger head is coupled to the one end of the plunger shaft. A second end cap covers the second end of the tube. The second end cap has a central hole therethrough through which the plunger shaft is slidably extended. A handle is coupled to the other end of the plunger shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water squirting device apparatus and method which has many of the advantages of the water squirting devices mentioned heretofore and many novel features that result in a new water squirting device which is not anticipated, rendered obvious, suggested, or even implied by any of the prior art water squirting devices, either alone or in any combination thereof.

It is another object of the present invention to provide a new water squirting device which may be easily and efficiently manufactured and marketed.

It is a further object of the present invention to provide a new water squirting device which is of a durable and reliable construction.

An even further object of the present invention is to provide a new water squirting device which is susceptible of a low cost of manufacture with regard to both materials and labor, and which accordingly is then susceptible of low prices of sale to the consuming public, thereby making such water squirting device economically available to the buying public.

Still yet another object of the present invention is to provide a new water squirting device which provides in the apparatuses and methods of the prior art some of the advantages thereof, while simultaneously overcoming some of the disadvantages normally associated therewith.

Still another object of the present invention is to provide a new water squirting device for squirting water a distance therefrom.

Yet another object of the present invention is to provide a new water squirting device which includes an elongate tube has inner and outer surfaces, and opposite first and second ends. The inner surface of the tube defining a lumen of the tube. The first and second ends of the tube each have an opening into the lumen of the tube. A first end cap covers the first end of the tube and has a squirt hole therethrough. One of the ends of a plunger shaft is inserted through the second end of the tube and into the lumen of the tube. A plunger head is coupled to the one end of the plunger shaft. A second end cap covers the second end of the tube. The second end cap has a central hole therethrough through which the plunger shaft is slidably extended. A handle is coupled to the other end of the plunger shaft.

Still yet another object of the present invention is to provide a new water squirting device that has few moving parts for durability and can dispense a stream of water between 30 and 40 feet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
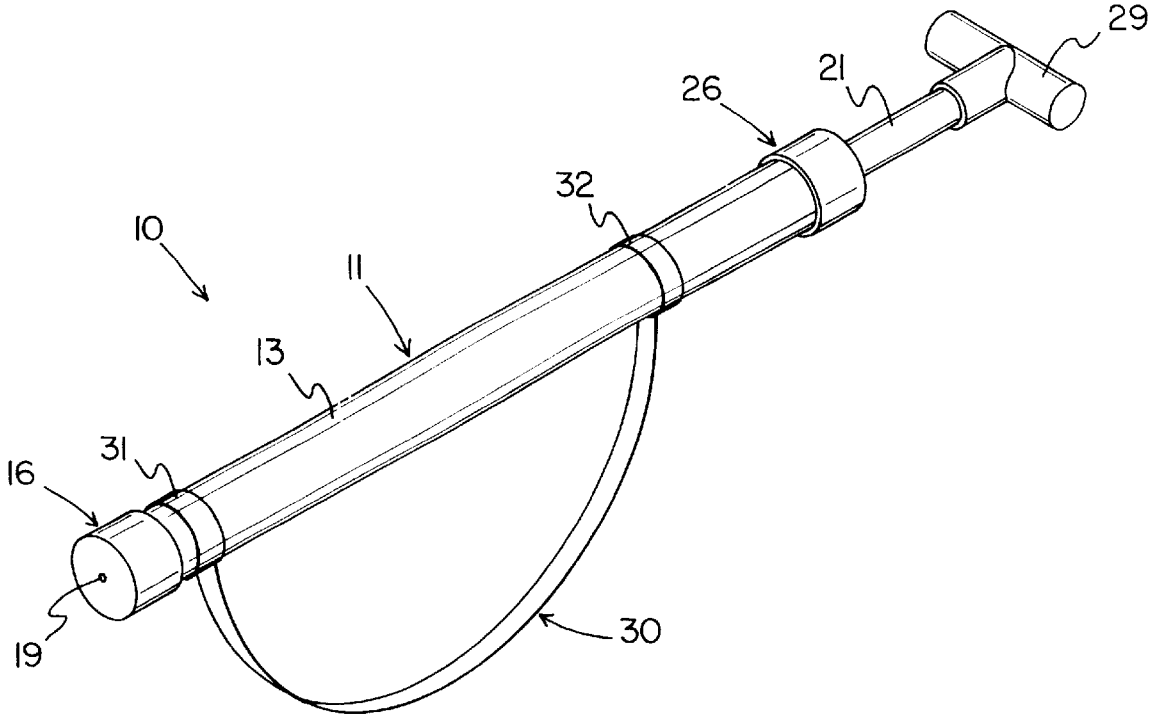
FIG. 1 is a schematic perspective view of a new water squirting device according to the present invention.
Figure 2:
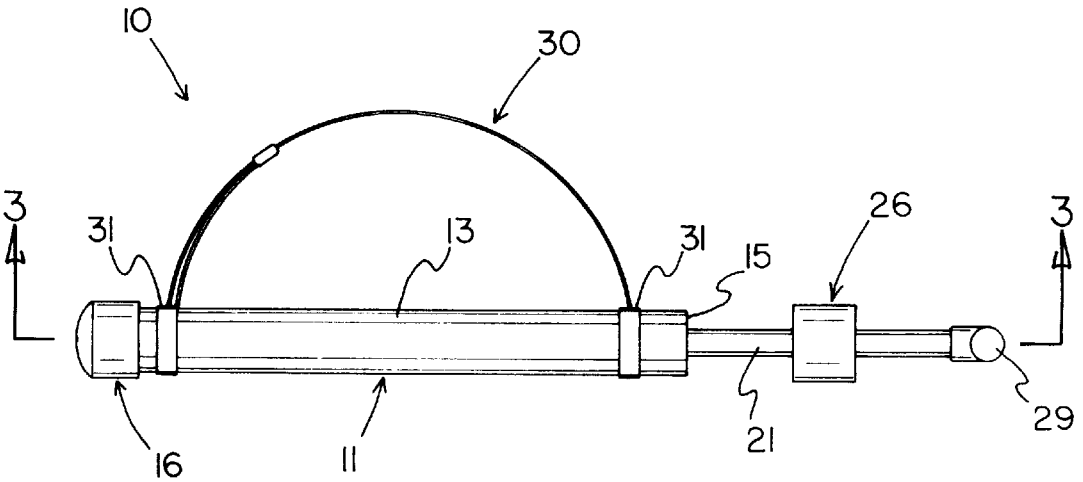
FIG. 2 is a schematic side view of the present invention with the second end cap detached from the second end of the tube.
Figure 3:
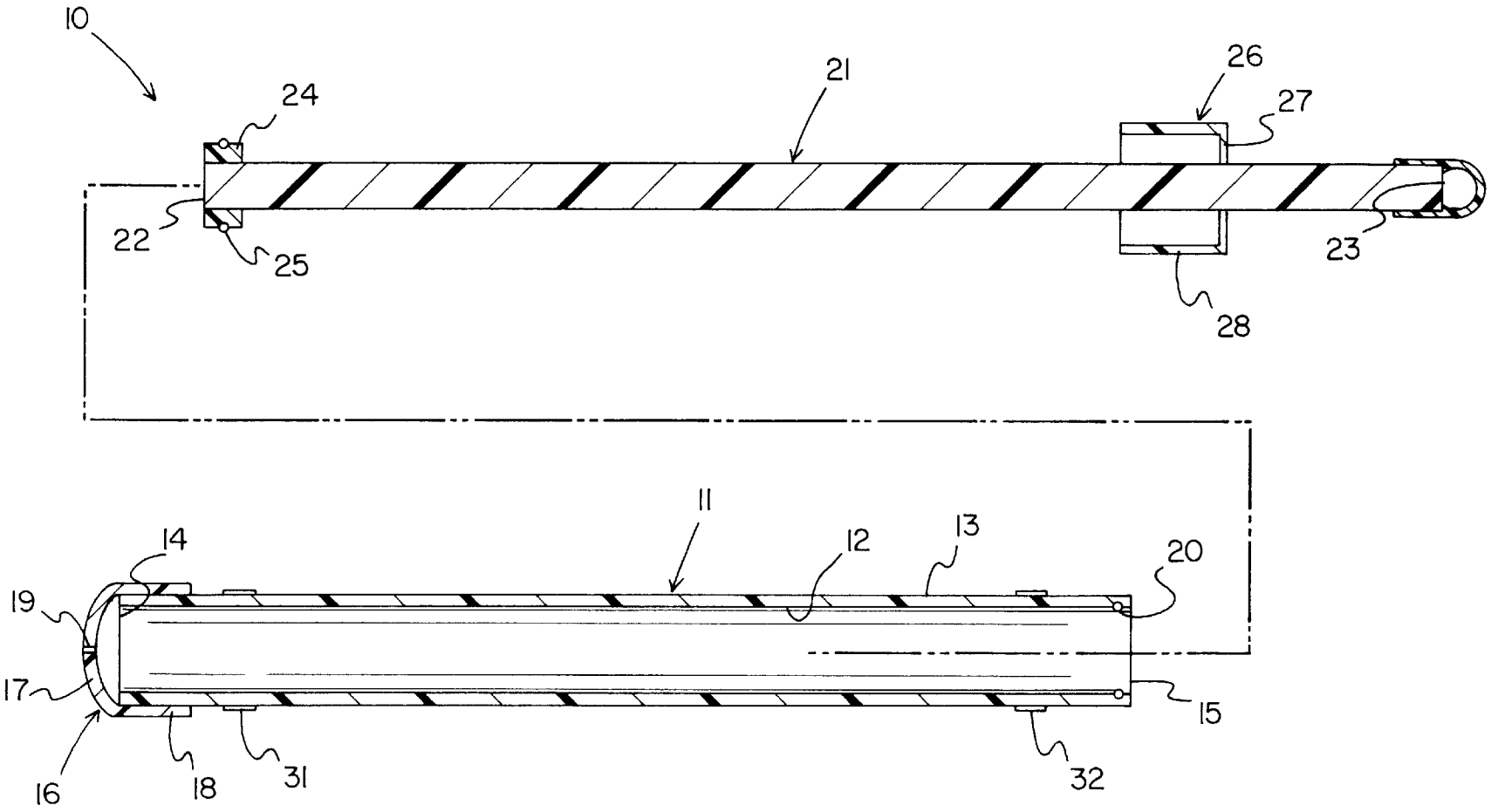
FIG. 3 is a schematic cross-sectional view of the present invention taken from line 3—3 of FIG. 2.

With reference now to the drawings, and in particular to FIGS. 1 through 3 thereof, a new water squirting device embodying the principles and concepts of the present invention and generally designated by the reference numeral 10 will be described.

As best illustrated in FIGS. 1 through 3, the water squirting device 10 generally comprises an elongate tube 11 has inner and outer surfaces 12,13, and opposite first and second ends 14,15. The inner surface 12 of the tube 11 defining a lumen of the tube 11. The first and second ends 14,15 of the tube 11 each have an opening into the lumen of the tube 11. A first end cap 16 covers the first end 14 of the tube 11 and has a squirt hole 19 therethrough. One of the ends 22 of a plunger shaft 21 is inserted through the second end 15 of the tube 11 and into the lumen of the tube 11. A plunger head 24 is coupled to the one end 22 of the plunger shaft 21. A second end cap 26 covers the second end 15 of the tube 11. The second end cap 26 has a central hole therethrough through which the plunger shaft 21 is slidably extended. A handle 29 is coupled to the other end 23 of the plunger shaft 21.

In closer detail, the elongate tube 11 is generally cylindrical and has inner and outer surfaces 12,13, and opposite first and second ends 14,15. The inner surface 12 of the tube 11 defines the lumen of the tube 11 which is designed for holding a volume of water therein. The first and second ends 14,15 of the tube 11 each have an opening into the lumen of the tube 11. The openings of the first and second ends 14,15 of the tube 11 are generally circular. The tube 11 has a diameter. Ideally, the diameter of the tube 11 is about ¾ inch. The tube 11 also has a length defined between the first and second ends 14,15. Preferably, the length of the tube 11 is between about 10 inches and about 30 inches. Ideally, the length of the tube 11 is about 20 inches.

The first end cap 16 covers the first end 14 of the tube 11. The first end cap 16 has a generally circular end portion 17 and a cylindrical side wall 18 extending around the perimeter of the end portion 17 of the first end cap 16. The first end 14 of the tube 11 is inserted into the first end cap 16 so that the first end cap covers the first end of the tube. The end portion 17 of the first end cap 16 has a center and a squirt hole 19 therethrough. Preferably, the squirt hole 19 is positioned at the center of the end portion 17 of the first end cap 16. The squirt hole 19 is designed for squirting water from the lumen of the tube 11 out of.

The elongate plunger shaft 21 has a pair of opposite ends 22,23. The plunger shaft 21 is generally cylindrical and has a diameter and a length defined between the ends of the plunger shaft 21. The diameter of the plunger shaft 21 is less than the diameter of the tube 11. One of the ends 22 of the plunger shaft 21 is inserted through the second end 15 of the tube 11 and into the lumen of the tube 11. A plunger head 24 is coupled to the one end 22 of the plunger shaft 21 such that the plunger head 24 is positioned between the one end 22 of the tube 11 and the first end cap 16. The plunger head 24 is designed for pushing water in the lumen of the tube 11 towards the squirt hole 19 of the first end cap 16. The plunger head 24 is generally cylindrical and has a diameter which is slightly less than the inner diameter of the tube 11. The plunger head 24 has an annular plunger gasket 25, or O-ring, around the diameter of the plunger head 24. The annular plunger gasket 25 abuts the inner surface 12 of the tube 11 around the plunger head 24 to provide a substantially water tight seal between the inner surface 12 of the tube 11 and the plunger head 24 such that water does not easily leak into the space of the lumen between the plunger head 24 and the second end 15 of the tube 11.

The second end cap 26 is designed for covering the second end 15 of the tube 11 and the second end 15 of the tube 11 is inserted into second end cap 26 to cover the second end 15. The second end cap 26 has a generally circular end portion 27 and a cylindrical side wall 28 extending around the perimeter of the end portion 27 of the second end cap 26. The end portion 27 of the second end cap 26 has a central hole therethrough through which the plunger shaft 21 is slidably extended such that the second end cap 26 is disposed around the plunger shaft 21 with the side wall 28 of the second end cap 26 facing the one end 22 of the plunger shaft 21 and the other end 23 of the plunger shaft 21 outwardly extending from the second end 15 of the tube 11. The inner surface 12 of the tube 11 has an annular end gasket 20, or O-ring, therearound. The annular end gasket 20 of the inner surface 12 of the tube 11 is positioned adjacent the second end 15 of the tube 11.

A generally T-shaped handle 29 is coupled to another end of the plunger shaft 21. The handle 29 is designed for grasping by a user to push and pull the plunger shaft 21 towards and away from the first end 14 of the tube 11. In use, water is sucked through the squirt hole 19 into the lumen of the tube 11 when the plunger shaft 21 is pulled away from the first end 14 of the tube 11 to fill the lumen with water. When the plunger head is pushed by the plunger shaft towards the first end of said tube, water is forced through the squirt hole.

Preferably an elongate flexible shoulder strap 30 is provided. The shoulder strap has a pair of opposite ends 31,32 which are coupled to the outer surface 13 of the tube 11. One of the ends 31 of the shoulder strap 30 is positioned towards the first end 14 of the tube 11 and the other end 32 of the shoulder strap 30 is positioned towards the second end 15 of the tube 11. Preferably, each of the ends of the shoulder strap 30 are looped around the outer surface 13 of the tube 11 and coupled to an adjacent portion of the shoulder strap 30. Ideally, the shoulder strap 30 is an adjustable length shoulder strap 30 and has a width of about ¾ inch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water squirting device, comprising:

an elongate tube having inner and outer surfaces, and opposite first and second ends, said inner surface of said tube defining a lumein of said tube, said first and second ends of said tube each having an opening into said lumen of said tube;

a first end cap covering said first end of said tube, said first end cap having an end portion and a side wall therearound said end portion of said first end cap, said first end of said tube being inserted into said first end cap;

said end portion of said first end cap having a squirt hole therethrough;

said inner surface of said tube having an annular end gasket therearound, said annular end gasket of said inner surface of said tube being positioned adjacent said second end of said tube;

an elongate plunger shaft having a pair of opposite ends;

one of said ends of said plunger shaft being inserted through said second end of said tube and into said lumen of said tube;

a plunger head being coupled to said one of said ends of said plunger shaft;

said plunger head having an annular plunger gasket therearound, said annular plunger gasket abutting said inner surface of said tube around said plunger head;

a second end cap for covering said second end of said tube, said second end cap having an end portion and a side wall therearound said end portion of said second end cap;

said end portion of said second end cap having a central hole therethrough, said plunger shaft being slidably extended through said central hole of said second end cap such that said second end cap is disposed around said plunger shaft;

said second end of said tube being inserted into second end cap;

a handle being coupled to another end of said plunger shaft;

said end portion of said first end cap being rounded and having a concave inner face and a convex outer face;

said end portion of said first end cap having a curvature extending across diametric regions of said side wall of said first end cap;

an elongate flexible shoulder strap having a pair of opposite ends, said ends of said shoulder strap being looped around said outer surface of said tube and coupled to adjacent portions of said shoulder strap to couple said ends of said shoulder strap to said tube, one of said ends of said shoulder strap being positioned towards said first end of said tube, another of said ends of said shoulder strap being positioned towards said second end of said tube;

said squirt hole having an outer diameter about one-seventeenth an outer diameter of said tube for helping to spray a narrow stream of water out of said squirt hole a distance away from said first end cap;

said annular end gasket of said inner surface of said tube positioned adjacent said second end of said tube having an inner diameter, said plunger head having an outer diameter; and said inner diameter of said annular end gasket being less than said outer diameter of said plunger head such that annular end gasket abuts said plunger head when said plunger head is moved to said second end of said tube to inhibit removal of said plunger head from said second end of said tube.

2. The water squirting device of claim 1, wherein said end portion of said first end cap has a center, wherein said squirt hole is positioned at said center of said end portion of said first end cap.

3. The water squirting device of claim 1, wherein said outer diameter of said tube is about ¾ inch.

4. The water squirting device of claim 1, wherein said tube has a length defined between said first and second ends, wherein said length of said tube is between about 10 inches and about 30 inches.

5. The water squirting device of claim 4, wherein said length of said tube is about 20 inches.

6. A water squirting device, comprising:

an elongate tube being generally cylindrical and having inner and outer surfaces, and opposite first and second ends, said inner surface of said tube defining a lumen of said tube, said first and second ends of said tube each having an opening into said lumen of said tube, said openings of said first and second ends of said tube being generally circular;

said tube having a diameter, wherein said diameter of said tube is about ¾ inch, said tube having a length defined between said first and second ends, wherein said length of said tube is about 20 inches;

a first end cap covering said first end of said tube, said first end cap having a generally circular end portion and a cylindrical side wall around said end portion of said first end cap, said first end of said tube being inserted into said first end cap;

said end portion of said first end cap having a center and a squirt hole therethrough, said squirt hole being positioned at said center of said end portion of said first end cap;

said inner surface of said tube having an annular end gasket therearound, said annular end gasket of said inner surface of said tube being positioned adjacent said second end of said tube;

an elongate plunger shaft having a pair of opposite ends, said plunger shaft being generally cylindrical and having a diameter and a length defined between said ends of said plunger shaft, said diameter of said plunger shaft being less than said diameter of said tube;

one of said ends of said plunger shaft being inserted through said second end of said tube and into said lumen of said tube;

a plunger head being coupled to said one of said ends of said plunger shaft, said plunger head being for pushing water in said lumen of said tube towards said squirt hole of said first end cap, said plunger head being generally cylindrical and having a diameter;

said plunger head having an annular plunger gasket around said diameter of said plunger head, said annular plunger gasket abutting said inner surface of said tube around said plunger head;

a second end cap for covering said second end of said tube, said second end cap having a generally circular end portion and a cylindrical side wall around said end portion of said second end cap;

said end portion of said second end cap having a central hole therethrough, said plunger shaft being slidably extended through said central hole of said second end cap such that said second end cap is disposed around said plunger shaft;

said second end of said tube being inserted into second end cap;

a generally T-shaped handle being coupled to another end of said plunger shaft; and an elongate flexible shoulder strap having a pair of opposite ends, said ends of said shoulder strap being looped around said outer surface of said tube and coupled to adjacent portions of said shoulder strap to couple said ends of said shoulder strap to said tube, one of said ends of said shoulder strap being positioned towards said first end of said tube, another of said ends of said shoulder strap being positioned towards said second end of said tube;

said end portion of said first end cap being rounded and having a concave inner face and a convex outer face;

said end portion of said first end cap having a curvature extending across diametric regions of said side wall of said first end cap;

said squirt hole having an outer diameter about one-seventeenth an outer diameter of said tube for helping to spray a narrow stream of water out of said squirt hole a distance away from said first end cap;

said annular end gasket of said inner surface of said tube positioned adjacent said second end of said tube having an inner diameter, said plunger head having an outer diameter; and said inner diameter of said annular end gasket being less than said outer diameter of said plunger head such that annular end gasket abuts said plunger head when said plunger head is moved to said second end of said tube to inhibit removal of said plunger head from said second end of said tube.

* * * * *